US009135850B2

(12) United States Patent
Narayanan et al.

(10) Patent No.: US 9,135,850 B2
(45) Date of Patent: Sep. 15, 2015

(54) INDICATING OPERATING SYSTEM SELECTION

(71) Applicant: INTEL CORPORATION, Santa Clara, CA (US)

(72) Inventors: Anantha Narayanan, Bangalore (IN); Arvind S, Bangalore (IN); A. Ravindra Babu, Bangalore (IN)

(73) Assignee: Intel Corporation, Santa Clara, CA (US)

( * ) Notice: Subject to any disclaimer, the term of this patent is extended or adjusted under 35 U.S.C. 154(b) by 74 days.

(21) Appl. No.: 14/142,150

(22) Filed: Dec. 27, 2013

(65) Prior Publication Data

US 2015/0187257 A1 Jul. 2, 2015

(51) Int. Cl.

| | |
|---|---|
| ***G09G 5/02*** | (2006.01) |
| ***G09G 3/30*** | (2006.01) |
| ***G09G 3/34*** | (2006.01) |

(52) U.S. Cl.

CPC ..... *G09G 3/30* (2013.01); *G09G 3/3406* (2013.01); *G09G 2310/024* (2013.01); *G09G 2360/14* (2013.01)

(58) Field of Classification Search

CPC ..... G09G 3/00; G09G 3/22; G09G 3/34; G09G 3/3406; G09G 2360/141; G02B 26/007; G02F 1/01; G02F 1/0136; G02F 1/1335; F21V 7/00

See application file for complete search history.

(56) References Cited

U.S. PATENT DOCUMENTS

| | | | | |
|---|---|---|---|---|
| 6,827,034 | B1 * | 12/2004 | Paulo | 116/286 |
| 8,902,195 | B2 * | 12/2014 | McGibney et al. | 345/175 |
| 2003/0076463 | A1 * | 4/2003 | Ozawa et al. | 349/113 |
| 2008/0143560 | A1 * | 6/2008 | Shipman | 341/22 |
| 2009/0128499 | A1 * | 5/2009 | Izadi et al. | 345/173 |
| 2010/0271699 | A1 * | 10/2010 | Chang et al. | 359/485 |
| 2011/0047840 | A1 * | 3/2011 | Ou | 40/546 |
| 2011/0137965 | A1 * | 6/2011 | Yamashita et al. | 707/823 |
| 2012/0062527 | A1 * | 3/2012 | Cheong et al. | 345/204 |
| 2014/0051055 | A1 * | 2/2014 | Lee et al. | 434/353 |
| 2014/0071499 | A1 * | 3/2014 | Hayashide | 358/474 |

* cited by examiner

*Primary Examiner* — Joe H Cheng

(74) *Attorney, Agent, or Firm* — International IP Law Group, P.L.L.C.

(57) ABSTRACT

Techniques related to abrasion scorings for illuminating operating system selections are described herein. A first abrasion scoring of a display material may reflect light from a first light source resulting in an image associated with a first operating system of the computing device being illuminated at the display material. A second abrasion scoring of the display material may reflect light from a second light source resulting in an image associated with a second operating system of the computing device being illuminated at the display material.

23 Claims, 6 Drawing Sheets

200

400

100

200

300

400

500

INDICATING OPERATING SYSTEM SELECTION

TECHNICAL FIELD

This disclosure relates generally to techniques for illuminating light sources for operating system selections are described herein. Specifically, this disclosure relates to a display material having abrasion scorings to reflect an image associated with an operating system.

BACKGROUND ART

With the fast growth of computing devices, multifunctional computing devices may be desired by consumers. Some computing devices may be configured to load two or more types of operating systems. In some scenarios, a given operating system may include a home button that is unique to the operating system. During a pre-boot phase, a user may select an operating system to load on the computing device. In some scenarios, an image, such as a logo associated with the user selected operating system, may be displayed somewhere on the device.

BRIEF DESCRIPTION OF THE DRAWINGS

The same numbers are used throughout the disclosure and the figures to reference like components and features. Numbers in the 100 series refer to features originally found in FIG. 1; numbers in the 200 series refer to features originally found in FIG. 2; and so on.

DESCRIPTION OF THE EMBODIMENTS

The present disclosure relates generally to techniques for illuminating operating system selections. As discussed above, some computing devices may include dual operating system implementations, wherein a user may select from among multiple operating systems in a pre-boot stage. For example, an All-In-One computing device may include an operating system associated with a traditional desktop computer, as well as an operating system associated with a mobile computing device, such as tablet, smartphone, or the like. In many cases, a selected operating system may have a home button displaying an image associated with the selected operating system. The embodiments described herein include a first abrasion scoring and a second abrasion scoring of a display material. The display material may be a glass, acrylic, or other at least semitransparent material, wherein the abrasion scoring reflects light at intersecting points of the scoring such that a given image, such as a logo associated with a selected operating system, may be reflected. The embodiments described herein describe a technique wherein an image associated with a selected operating system is reflected at the display material due to the abrasion scoring.

Figure 1:
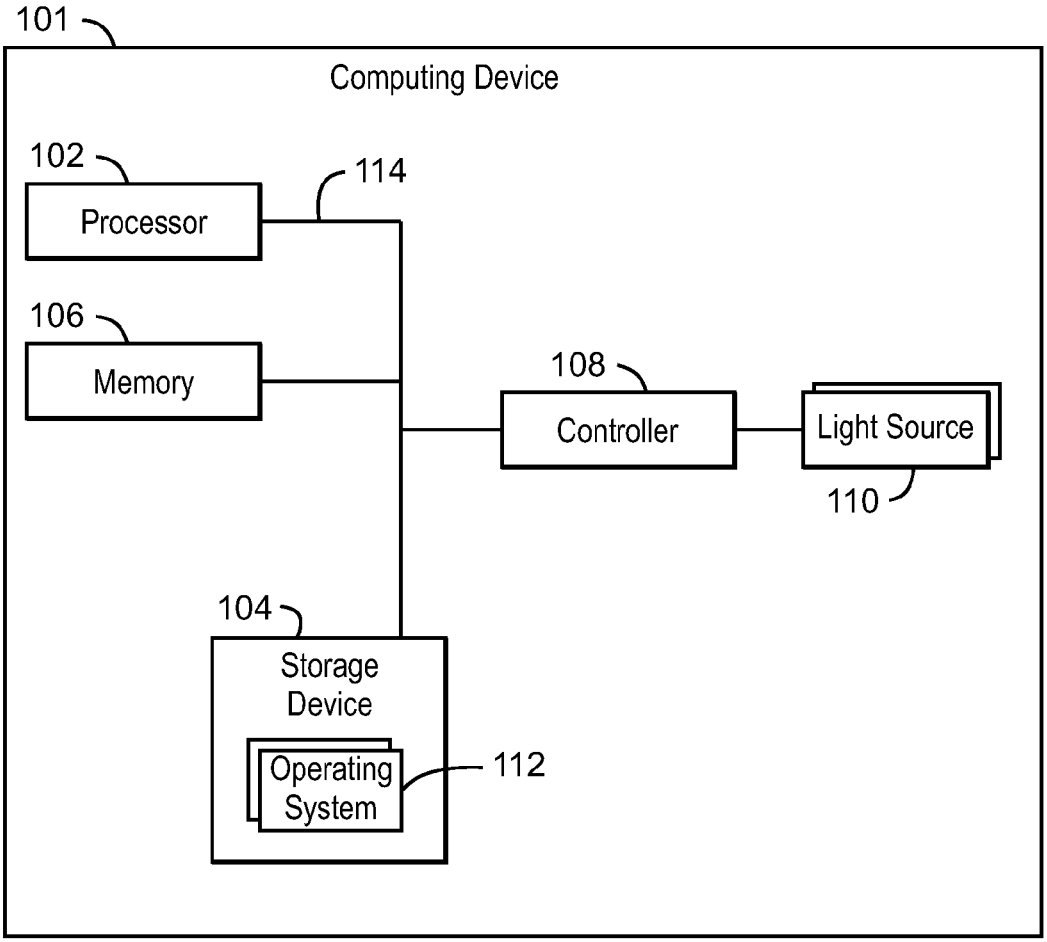
FIG. 1 is a block diagram of a computing device having control logic to illuminate a light source associated with an operating system selection.

FIG. 1 is a block diagram of a computing system configured to illuminate light sources associated with an operating system. The computing system 100 may include a computing device 101 having a processor 102, a storage device 104 comprising a non-transitory computer-readable medium, and a memory device 106. The computing device 101 may include a controller 108 and light sources 110, wherein the controller 108 may be configured to illuminate light sources associated with one of at least two operating systems 112.

The controller 108 may be logic, at least partially comprising hardware logic. In some embodiments, the controller 108 be a set of instructions stored on the storage device 104, that when executed by the processor 102, direct the computing device 101 to perform operations including receiving an operating system selection, and identifying a light source associate with the operating system selection. Whether the controller 108 is implemented as logic, an integrated circuit, or a set of instructions to be carried out by the processor 102, the controller 108 is configured to illuminate an identified light source such that an image associated with the selected operating system is reflected at abrasion scoring of a display material.

The processor 102 may be a main processor that is adapted to execute the stored instructions. The processor 102 may be a single core processor, a multi-core processor, a computing cluster, or any number of other configurations. The processor 102 may be implemented as Complex Instruction Set Computer (CISC) or Reduced Instruction Set Computer (RISC) processors, x86 Instruction set compatible processors, multi-core, or any other microprocessor or central processing unit (CPU).

The memory device 106 can include random access memory (RAM) (e.g., static random access memory (SRAM), dynamic random access memory (DRAM), zero capacitor RAM, Silicon-Oxide-Nitride-Oxide-Silicon SONOS, embedded DRAM, extended data out RAM, double data rate (DDR) RAM, resistive random access memory (RRAM), parameter random access memory (PRAM), etc.), read only memory (ROM) (e.g., Mask ROM, programmable read only memory (PROM), erasable programmable read only memory (EPROM), electrically erasable programmable read only memory (EEPROM), etc.), flash memory, or any other suitable memory systems. The main processor 102 may be connected through a system bus 114 (e.g., Peripheral Component Interconnect (PCI), Industry Standard Architecture (ISA), PCI-Express, HyperTransport®, NuBus, etc.) to components including the memory 106, the storage device 104, and the controller 108.

The block diagram of FIG. 1 is not intended to indicate that the computing device 101 is to include all of the components shown in FIG. 1. Further, the computing device 101 may include any number of additional components not shown in FIG. 1, depending on the details of the specific implementation.

Figure 2:
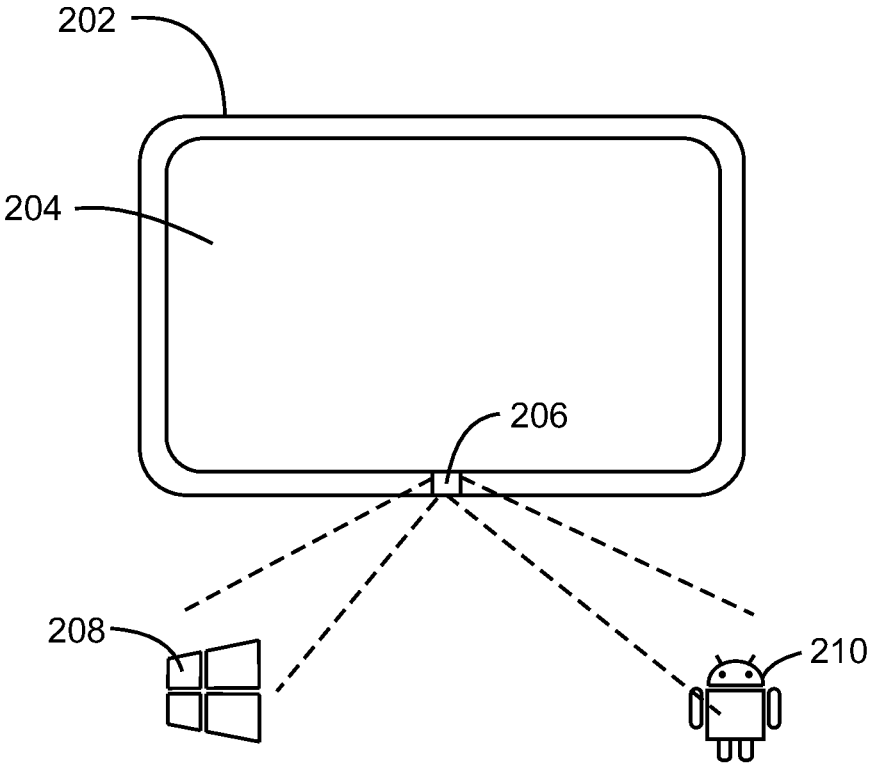
FIG. 2 is a front view of a computing device having an image associated with an operating system projected by light sources.

FIG. 2 is a front view of a computing device having an image associated with an operating system projected by light sources. The computing device 200 may be an All-In-One (AIO) computing device, wherein components of the computing device, such as the processor 102, the memory 106, the storage device 112 of FIG. 1, and the like, are collocated in a single housing 202 including a display 204. The housing 202 may also include a display material 206. In embodiments, the display material 206 is a display window composed of an at least semi-transparent material, wherein images, such as the images 208 and 210 are projected upon. Although FIG. 2 illustrates the images 208, 210 as being projected past the display material 206, the images 208, 210 may be reflected at the display material as discussed in more detail below in reference to FIG. 3 and FIG. 4.

The images 208 and 210 may each be associated with operating systems, such as the operating systems 112, of FIG. 1. Additionally, the computing device 200 may be configured to enable a user to boot either one of the operating systems 112. Once a given operating system is selected in a pre-boot stage, such as in a basic input/output system (BIOS), the image associated with the selected operating system may be projected by light sources as discussed in more detail below in reference to FIG. 4.

Figure 3:
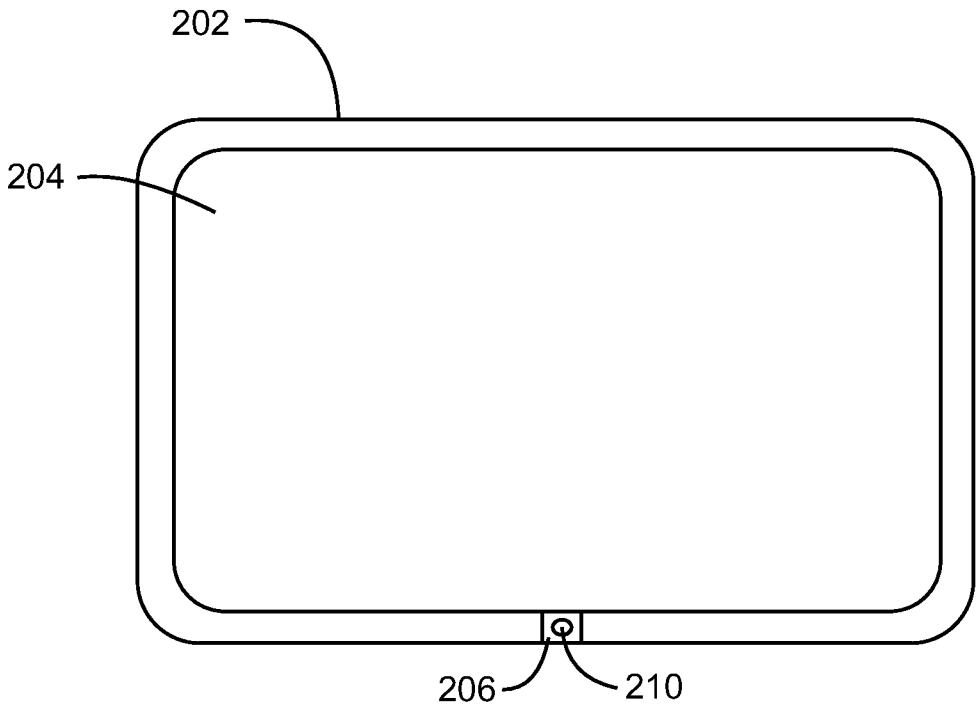
FIG. 3 is a front view of a computing device having an image reflected at a display material.

FIG. 3 is a front view of a computing device having an image reflected at a display material. In contrast to FIG. 3, the images need not be necessarily projected past the display material 206. As illustrated in FIG. 3, a given image, such as the image 210, may be reflected at abrasion scorings of the display material 206 as discussed in more detail below in reference to FIG. 4.

Figure 4:
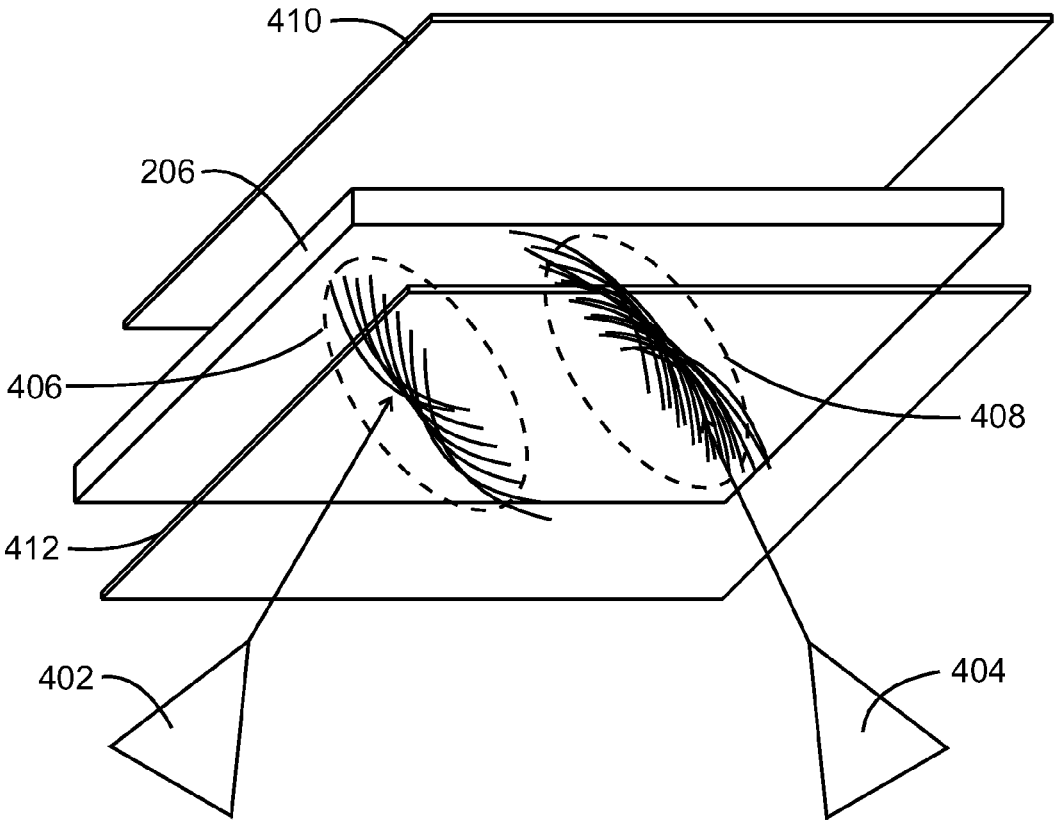
FIG. 4 is a perspective view of a display material having abrasion scoring to reflect light from light sources.

FIG. 4 is a perspective view of a display material having abrasion scoring to reflect light from light sources. The display material 206 may be a part of an indication system, or an indication apparatus, 400. The light sources 402, 404 may be disposed within a housing of a computing device, such as the housing 202 of the computing device 200 discussed above in reference to FIG. 2 and FIG. 3. As illustrated in FIG. 4, the display material 206 may include abrasion scorings as indicated by the dashed circles 406 and 408. The light from each of the light sources 402 and 404 may be reflected at the abrasion scorings 406 and 408, respectively. In embodiments, each abrasion scoring 406 and 408 includes multiple arcs having intersection points. The intersection points may be configured to reflect a certain image when a respective light source, such one of light sources 402 and 404, shines upon the intersection points. The image reflected at the intersection point may be associated with a given selected operating system.

In some embodiments, a first polarizing material 410 may be used on the outer surface of the display material 206. A second polarizing 412 material, having an opposite polarity than the first polarizing material 410, may be used on the inner surface of the display material 206. The opposite polarity between the first and second polarizing material 410 and 412 enables the display material 206 to display an image as light is reflected from the light sources 402 and 404, while appearing dark, similar to a dark coloring of a housing, such as the housing 202 of FIG. 2 and FIG. 3, when the light sources 402 and 404 are not illuminated.

Figure 5:
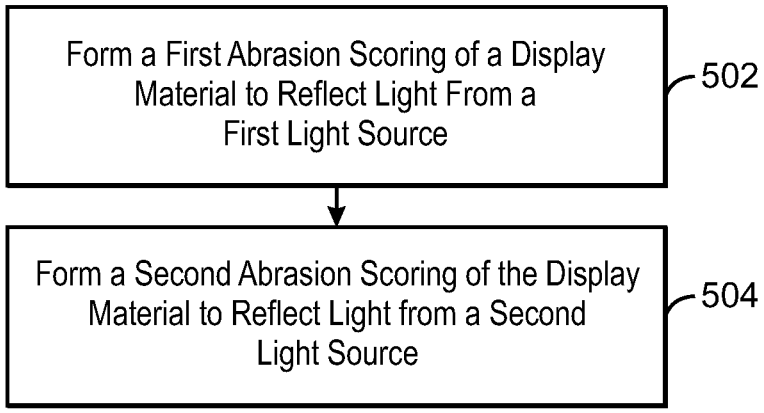
FIG. 5 is a block diagram illustrating a method for forming an indicator apparatus.

FIG. 5 is a block diagram illustrating a method for forming an indicator apparatus. The method 500 may include forming, at block 502, a first abrasion scoring of a display material to reflect light from a first light source resulting in an image associated with a first operating system of the computing device. A second abrasion scoring may be formed at block 504. The second abrasion scoring may be configured to reflect light from a second light source resulting in an image associated with a second operating system of the computing device.

In embodiments, the first light source and the second source may be non-moving components of the computing device. In some embodiments, the method 500 includes forming a first polarization material and a second polarization material having opposite polarities. The first polarization material may be disposed on an outer surface and the second polarization material may be disposed on an inner surface of the display material. The polarization materials may enable light incoming from the outside of the indicator apparatus to be reflected back appearing dark, whereas light originating from one or more of the light sources may propagate through the display material such that an image associated with a selected operating system may be visible to outside observers.

Figure 6:
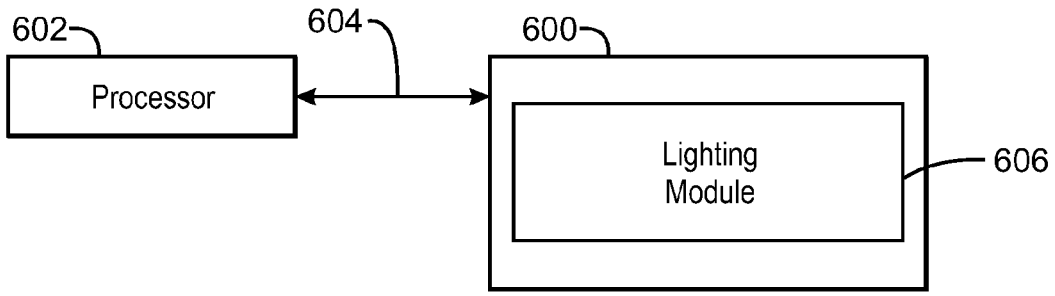
FIG. 6 is a block diagram depicting an example of a tangible, non-transitory computer-readable medium configured to illuminate a light source such that an image is reflected at a display material.

FIG. 6 is a block diagram depicting an example of a tangible, non-transitory computer-readable medium configured to illuminate a light source based on an operating system selection. The tangible, non-transitory, computer-readable medium 600 may be accessed by a processor 602 over a computer bus 604. Furthermore, the tangible, non-transitory, computer-readable medium 600 may include computer-executable instructions to direct the processor 602 to perform the steps of the current method.

The various software components discussed herein may be stored on the tangible, non-transitory, computer-readable medium 600, as indicated in FIG. 5. For example, a lighting module 606 may be configured to receive an operating system selection. In embodiments, the selection may be input by a user at a BIOS of a computing system associated with the computer-readable medium 600. The lighting module 606 is to identify a light source associate with the operating system selection, and illuminate the light source such that an image associated with the operating system is reflected at abrasion scoring of a display material.

An embodiment is an implementation or example. Reference in the specification to "an embodiment," "one embodiment," "some embodiments," "various embodiments," or "other embodiments" means that a particular feature, structure, or characteristic described in connection with the embodiments is included in at least some embodiments, but not necessarily all embodiments, of the present techniques. The various appearances of "an embodiment," "one embodiment," or "some embodiments" are not necessarily all referring to the same embodiments.

Not all components, features, structures, characteristics, etc. described and illustrated herein need be included in a particular embodiment or embodiments. If the specification states a component, feature, structure, or characteristic "may", "might", "can" or "could" be included, for example, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

It is to be noted that, although some embodiments have been described in reference to particular implementations, other implementations are possible according to some embodiments. Additionally, the arrangement and/or order of circuit elements or other features illustrated in the drawings and/or described herein need not be arranged in the particular way illustrated and described. Many other arrangements are possible according to some embodiments.

In each system shown in a figure, the elements in some cases may each have a same reference number or a different reference number to suggest that the elements represented could be different and/or similar. However, an element may be flexible enough to have different implementations and work with some or all of the systems shown or described herein. The various elements shown in the figures may be the same or different. Which one is referred to as a first element and which is called a second element is arbitrary.

It is to be understood that specifics in the aforementioned examples may be used anywhere in one or more embodiments. For instance, all optional features of the computing device described above may also be implemented with respect to either of the methods or the computer-readable medium described herein. Furthermore, although flow diagrams and/or state diagrams may have been used herein to describe embodiments, the techniques are not limited to those diagrams or to corresponding descriptions herein. For example, flow need not move through each illustrated box or state or in exactly the same order as illustrated and described herein.

The present techniques are not restricted to the particular details listed herein. Indeed, those skilled in the art having the benefit of this disclosure will appreciate that many other variations from the foregoing description and drawings may be made within the scope of the present techniques. Accordingly, it is the following claims including any amendments thereto that define the scope of the present techniques.

What is claimed is:

1. An indicator apparatus of a computing device, comprising:

a first abrasion scoring of a display material to reflect light from a first light source resulting in an image associated with a first operating system of the computing device being illuminated at the display material; and a second abrasion scoring of the display material to reflect light from a second light source resulting in another image associated with a second operating system of the computing device being illuminated at the display material.

2. The indicator apparatus of claim 1, wherein the first light source and the second light source are non-moving components of the computing device.

3. The indicator apparatus of claim 1, comprising:

a first polarizing material disposed on an outer surface of the display material; and a second polarizing material disposed on an inner surface of the display material, wherein the second polarizing material is of opposite polarity to the first polarizing material.

4. The indicator apparatus of claim 3, wherein the first polarizing material and the second polarizing material are disposed such that light from one of the light sources is visible on the outer surface of the display material.

5. The indicator apparatus of claim 1, comprising logic, at least partially comprising hardware logic, to:

determine an operating system selection; and turn on a light source associated with the operating system selected resulting in an image associated with the operating system being reflected at the associated abrasion scoring.

6. The indicator apparatus of claim 5, wherein the operating system selection is provided by a user at a basic input output system (BIOS) of the computing device.

7. The indicator apparatus of claim 1, wherein the abrasion scoring comprises a set of arcs having one or more common meeting points wherein the light is reflected at each of the common meeting points.

8. The indicator apparatus of claim 1, wherein the computing device is an all-in-one (AIO) computing device.

9. An indication system of a computing device, comprising:

a first light source;

a second light source; and a display material comprising two sets of abrasion scorings, such that light from the first light source is to be reflected to illuminate a first image at a first set of abrasion scorings, and such that light from the second light source is to be reflected to illuminate a second image at a second set of abrasion scorings.

10. The indication system of claim 9, wherein the first light source and the second light source are non-moving components of the computing device.

11. The indication system of claim 9, comprising: a first polarizing material disposed on an outer surface of the display material; and a second polarizing material disposed on an inner surface of the display material, wherein the second polarizing material is of opposite polarity to the first polarizing material.

12. The indication system of claim 11, wherein the first polarizing material and the second polarizing material are disposed such that light from one of the light sources is visible on the outer surface of the display material.

13. The indication system of claim 9, wherein each set of abrasion scorings are associated with a different operating system image.

14. The indication system of claim 13, comprising logic, at least partially comprising hardware logic, to:

determine an operating system selection; and turn on a light source associated with the operating system selected resulting in the image associated with the selected operating system being reflected at the associated abrasion scoring set.

15. The indicator system of claim 14, wherein the operating system selection is provided by a user at a basic input output system (BIOS) of the computing device.

16. The indicator system of claim 9, wherein the computing device is an all-in-one (AIO) computing device.

17. A non-transitory computer readable medium including code, when executed, to cause a processing device to:

receive an operating system selection;

identify a light source associate with the operating system selection;

illuminate the light source such that an image associated with the operating system is reflected at abrasion scoring of a display material.

18. The non-transitory computer readable medium of claim 17, wherein the operating system selection is received at a basic input output system (BIOS) prior to booting the operating system, and wherein the light source is illuminated such that the image is reflected at the display material during a booting process of the operating system selected.

19. The non-transitory computer readable medium of claim 17, wherein image associated with the operating system is a logo of the operating system.

20. The non-transitory computer readable medium of claim 17, wherein the non-transitory computer readable medium is processing element of an All-In-One computing device having a dual operation system feature.

21. A method of forming an indicator apparatus of a computing device, comprising:

forming a first abrasion scoring of a display material to reflect light from a first light source resulting in an image associated with a first operating system of the computing device being illuminated at the display material;

forming a second abrasion scoring of the display material to reflect light from a second light source resulting in another image associated with a second operating system of the computing device being illuminated at the display material.

22. The indicator apparatus of claim 21, wherein the first light source and the second light source are non-moving components of the computing device.

23. The indicator apparatus of claim 21, comprising:

forming a first polarizing material disposed on an outer surface of the display material; and forming a second polarizing material disposed on an inner surface of the display material, wherein the second polarizing material is of opposite polarity to the first polarizing material.

* * * * *